United States Patent [19]

Flanigan et al.

[11] 4,353,400

[45] Oct. 12, 1982

[54] CONTROLLED CHIP CUTTERHEAD FOR PLANERS AND JOINTERS

[75] Inventors: Richard J. Flanigan; Charles L. Boles, both of McMinnville, Tenn.

[73] Assignee: Houdaille Industries, Inc., Fort Lauderdale, Fla.

[21] Appl. No.: 199,951

[22] Filed: Oct. 23, 1980

[51] Int. Cl.[3] ..... B27C 1/14

[52] U.S. Cl. ..... 144/117 R; 144/230

[58] Field of Search ..... 407/5, 37, 38, 39, 41, 407/45, 49; 144/162 R, 172, 174, 218, 230, 117 R

[56] References Cited

U.S. PATENT DOCUMENTS

| | | | |
|---|---|---|---|
| 2,836,206 | 5/1958 | Gaskell | 144/117 R |
| 3,933,189 | 1/1976 | Boles et al. | 144/117 R |
| 4,243,085 | 1/1981 | Gemmani | 144/117 R |
| 4,305,440 | 12/1981 | Lacasse | 144/230 |

FOREIGN PATENT DOCUMENTS

| | | | |
|---|---|---|---|
| 626761 | 9/1927 | France | 144/230 |
| 529632 | 11/1940 | United Kingdom | 144/230 |
| 2007149 | 5/1979 | United Kingdom | 144/230 |

OTHER PUBLICATIONS

Powermatic Houdaille, Inc., McMinnville, Tennessee, Catalog DD.

*Primary Examiner*—W. D. Bray

*Attorney, Agent, or Firm*—Hill, Van Santen, Steadman, Chiara & Simpson

[57] ABSTRACT

Cutterheads operating in the gap between in-feed and out-feed tables of planers, jointers and the like wood cutting apparatus are provided with a body of increased diameter and a gib having a chipbreaker pocket shape that will expose only a minimum projection of the knife before the chip must curl into the pocket thereby reducing the potential bite of a kick back such as might occur by a tipping of the wood workpiece or by a pull out of the wood grain during the feeding of the workpiece to the cutting knives. The knives of the cutterhead protrude only as much above the cutterhead body as is required not to interfere with the advance of the workpiece per revolution of each knife, the gib is positioned with its chipbreaker pocket down from the tip of the knife no further than is necessary for chip thickness, and the chipbreaker pocket has a radius just sufficient to accommodate the curled chip at the maximum depth of the cut. Since the cutterhead body is larger and the blade exposure is less, the gap between the tables of the planer or jointer and the cutterhead is reduced. In addition, since the exposure of the knives above the body of the cutterhead is reduced, a lesser fan effect is achieved to decrease noise levels when the planer or jointer is idling. The cutterheads and gibs of this invention thus reduces the possibility of kick back, reduce the severity of kick back should it occur, reduce the severity of injury should contact with the blades occur, reduce chipping out and grain pull out to improve the quality of cut on wood burl or other swirl grain type wood workpieces and produce a tight curl chip that is easily handled by dust collectors.

13 Claims, 7 Drawing Figures

Fig. 5
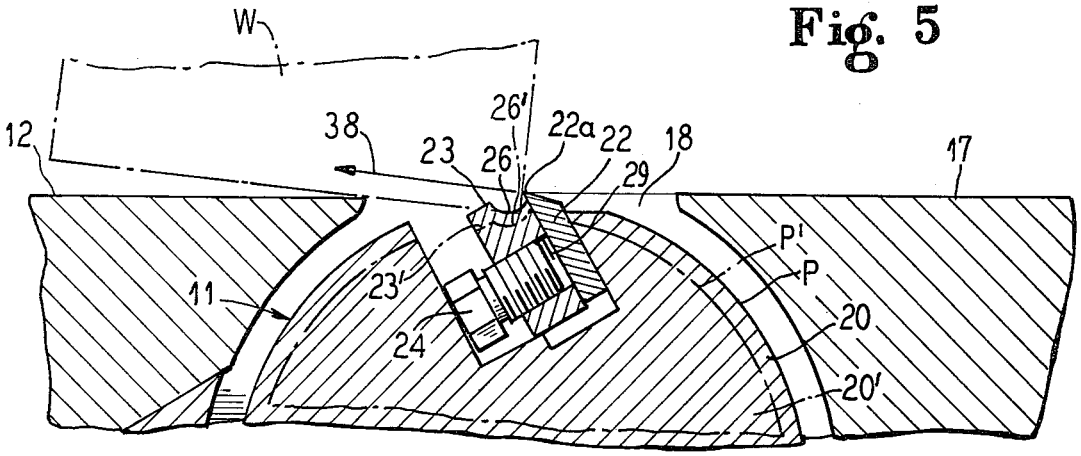
Fig. 6
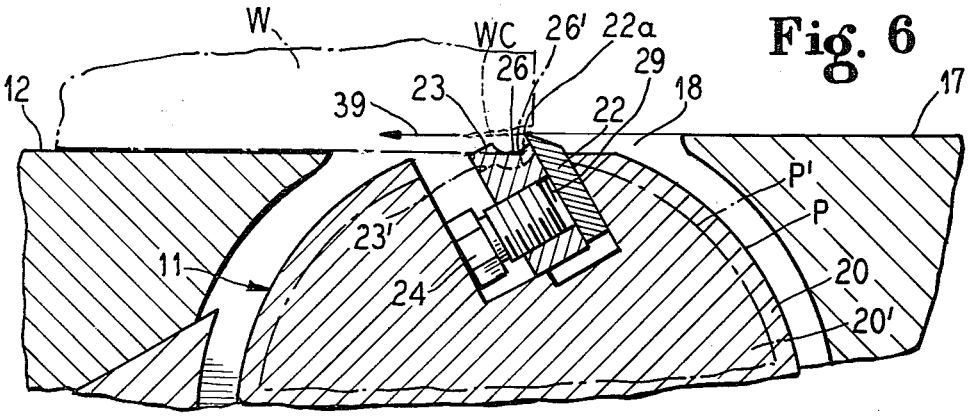
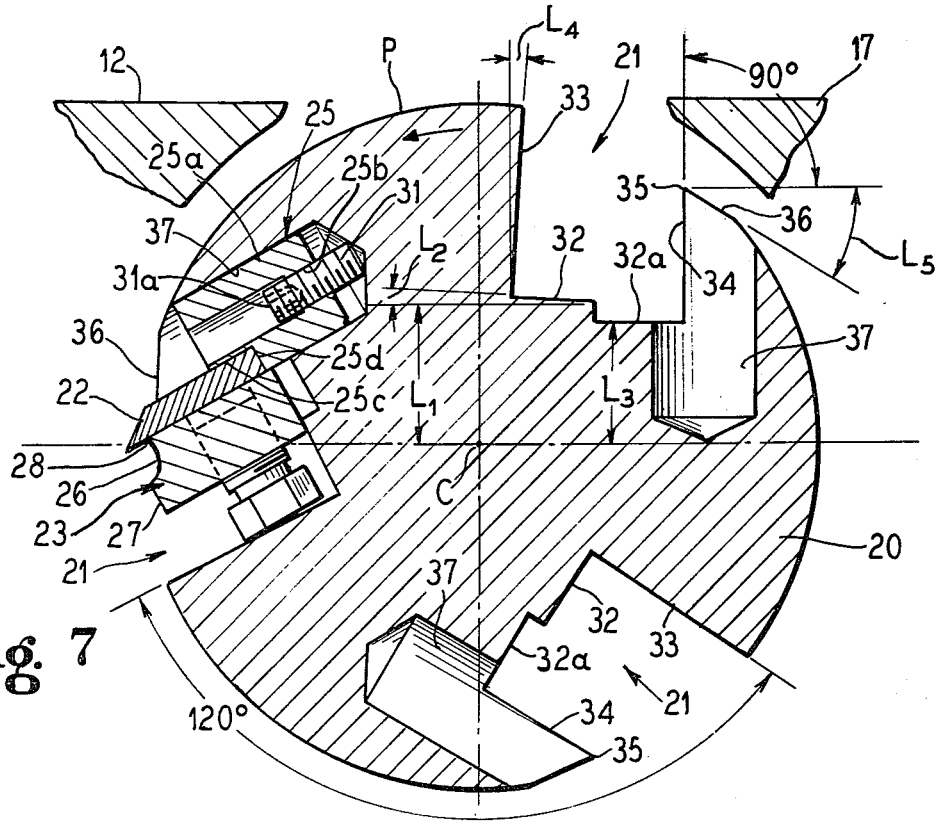
Fig. 7

CONTROLLED CHIP CUTTERHEAD FOR PLANERS AND JOINTERS

BACKGROUND OF THE INVENTION

1. Field of the Invention

This invention relates to the art of cutterheads for wood cutting machines such as planers and jointers and particularly deals with a cutterhead body of increased diameter with a modified gib shape to protrude the cutter knives just sufficient to maintain a maximum feed rate without kick back or grain pull out and to position the chipbreaker pocket or recess of the gib down from the tip of the knife no further than is necessary for chip thickness while providing a radius in the pocket that is just sufficient to accommodate the curled chip at the maximum depth of cut.

2. Prior Art

Heretofore it was customary to project each knife of a planer or jointer cutterhead about 0.125 inches above the cutterhead body and to set the chipbreaker down about the same distance below the tip of the knife. This leaves an appreciable exposure of 0.125 or more inches of the knife which can effect a sudden bite on the wood workpiece causing a kick back. Further, the depth of the chipbreaker from the tip of the knife was greater than the maximum cut which prevented good chip control. It would then be an improvement in the art to increase the diameter of the cutterhead body, to protrude the knives carried by the body just enough to make a cut without interferring with the feed rate, to position the chipbreaker down from the tip of the knife just sufficient to accommodate the chip thickness and to provide just enough radius in the chipbreaker to accommodate the curled chip at a maximum depth of the cut.

SUMMARY OF THE INVENTION

According to this invention cutterhead bodies of planers, jointers and the like wood cutting apparatus are increased in diameter and have their gib recess or pocket formation modified to present the chipbreaker as close to the tip of a knife as possible to receive a maximum cut and to project the knife just sufficiently to form a maximum cut without interfering with the feed rate through the apparatus. The increase in diameter of the cutterhead body to decrease the projection of the knives from the periphery of the body not only minimizes danger of kick back through excessive exposed knife surface but also reduces the gap between infeed and outfeed tables and any effective fan blade area above the body to decrease the fan effect and reduce the noise level when the cutterhead is rotating between cutting operations. The larger cutterhead body, in decreasing the gap between the cutterhead and workpiece support surfaces, minimizes tipping of the workpiece while the reduced projection of the knives from the periphery of the cutterhead body is just enough to effect a maximum cut with a minimum exposure to kick back. The slots of the cutterhead body receiving the gibs and knives have draft angles or inclines cooperating with the locking bolts to create wedge locks prevent centrifugal force ejection of the knives. The level of the knives in the slots is accurately set by set screw adjusted tubular nuts in holes alongside the slots.

It is then an object of this invention to increase the efficiency and minimize kick back of rotating cutterheads in wood cutting apparatus such as planers and jointers.

Another object of the invention is to provide a cutterhead for planers and jointers having an increased body diameter, a decreased blade projecting dimension and an improved chip breaker shape and position to effectively curl the chips out by the knife.

A specific object of this invention is to provide cutterheads for planers and jointers with a plurality of knives projecting from the periphery of the cutterhead body a distance of only about 0.015 inches and with a gib on the leading edge of each knife forming a chipbreaker pocket for the chips cut by the knife which is just sufficiently deep to receive a maximum cut and only expose about 0.032 inches of the blade.

Other and further objects of this invention will become apparent to those skilled in this art from the following detailed description of annexed sheets of drawings forming a part of this specification and showing a preferred embodiment of the invention while also comparing the invention with the prior art.

On the Drawings

FIG. 5 is a view similar to FIG. 3 comparing the cutterhead of this invention with the prior art and illustrating the tip-in type of kick back of a wood workpiece which is reduced by this invention;

FIG. 6 is a view similar to FIG. 5 but illustrating the grain pull-out type of kick back of the prior art which is also avoided by this invention;

FIG. 7 is a transverse cross-sectional view of the cutterhead assembly along the line VII—VII of FIG. 2 but omitting the knives and gibs in two of the slots.

AS SHOWN ON THE DRAWINGS

Figure 1:
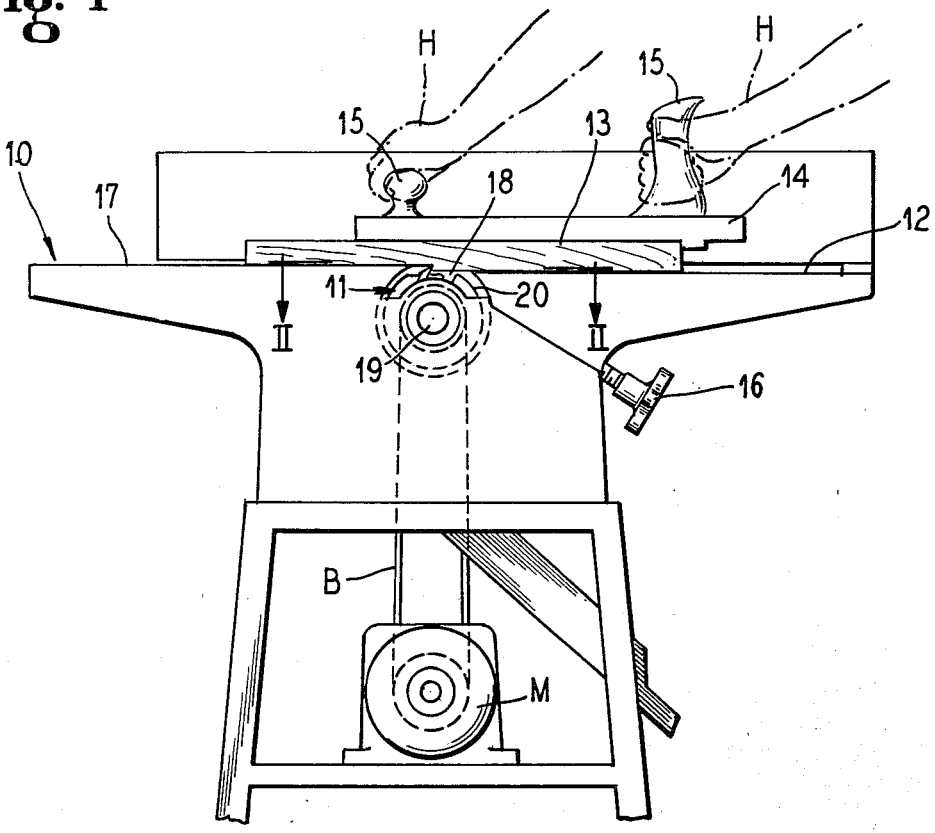
FIG. 1 is a front elevational view of a jointer equipped with a cutterhead according to this invention.
Figure 2:
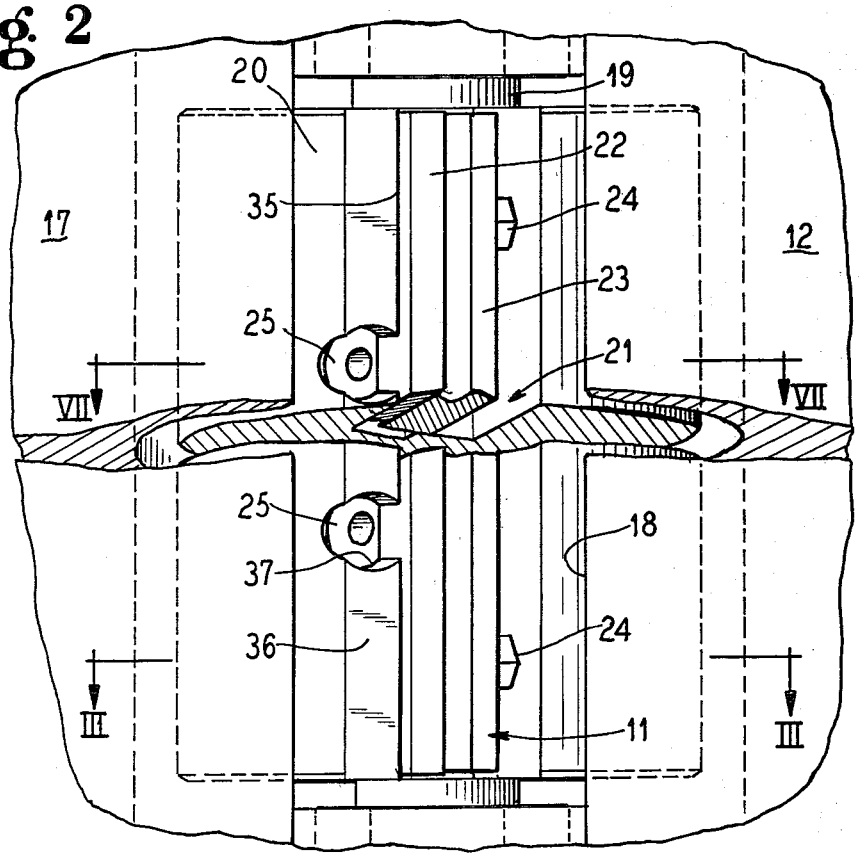
FIG. 2 is a fragmentary and broken horizontal sectional view along the line II—II of FIG. 1 and with parts in plan, showing the cutterhead of FIG. 1 on a larger scale.
Figure 3:
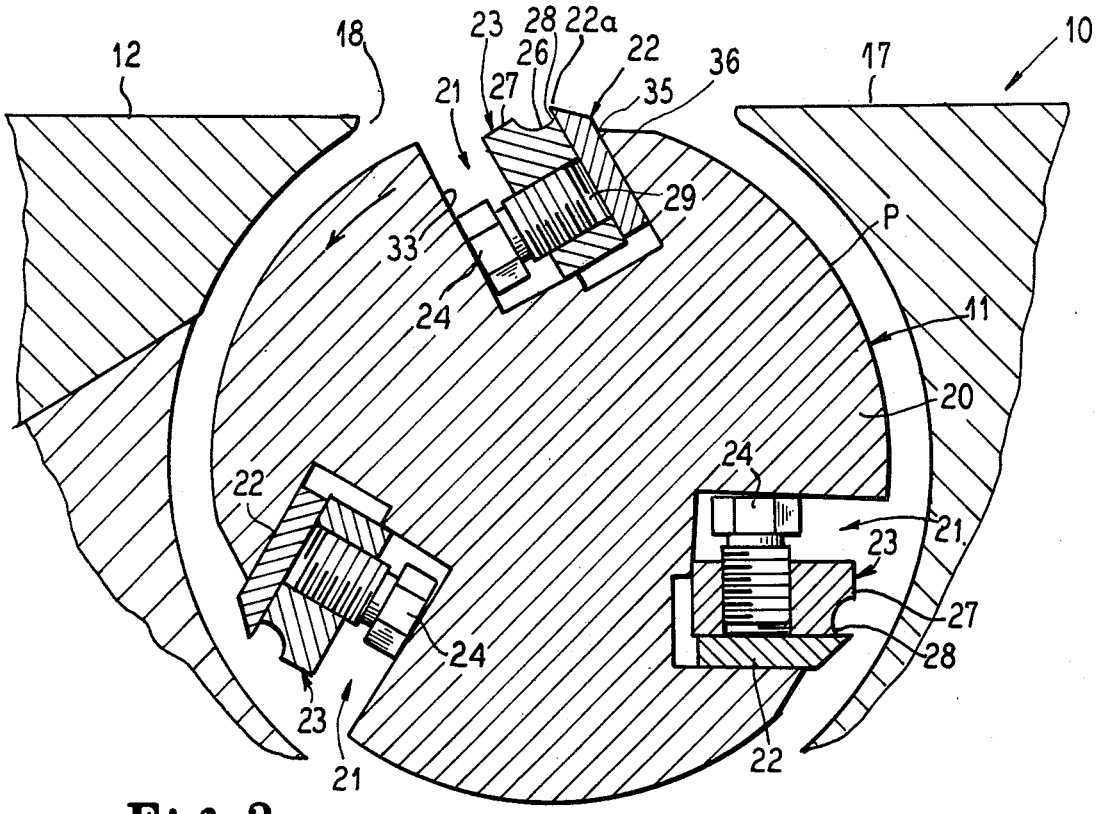
FIG. 3 is a fragmentary vertical cross sectional view along the line III—III of FIG. 2 on a larger scale.

In FIG. 1, the reference numeral 10 illustrates a conventional jointer equipped with a cutterhead assembly 11 of this invention. The jointer 10 has a variable level horizontal bed or in-feed table 12 for a wood workpiece 13 which is conveniently fed over the table 12 to the cutter assembly 11 by a protective guide 14 with handles 15 grasped by the hands H of an operator to hold the workpiece flat on the table and to push it over the cutterhead assembly 11. The height of the table 12 relative to the cutterhead is adjusted by a screw mechanism 16 for controlling the depth of cut. A fixed level bed or out-feed table 17 receives the workpiece 13 from the cutterhead 11 after it passes over a horizontal gap 18 between the tables 12 and 17. The cutterhead is rotated at high speeds by an electric motor or the like prime mover M through a belt drive B rotating a shaft 19 on which the body 20 of the cutterhead 11 is fixed.

Figure 4:
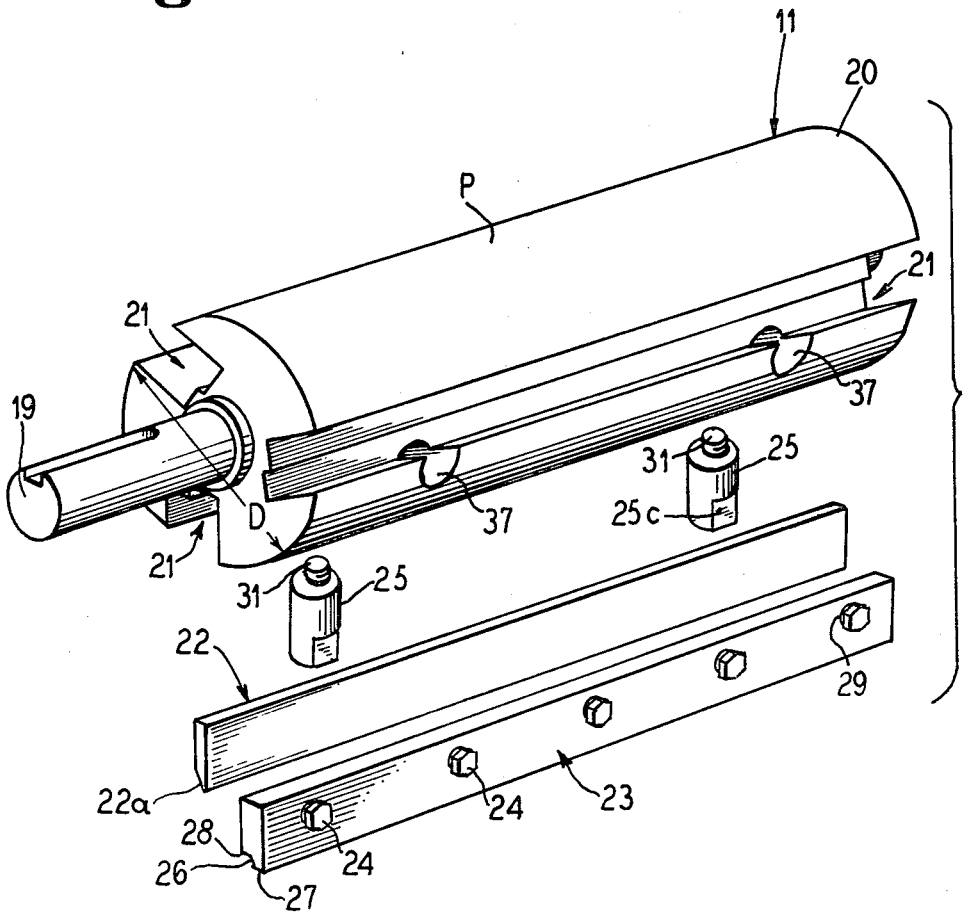
FIG. 4 is an exploded perspective view of the cutterhead body, one of its component knives, one of its chipbreaker gibs, two of the adjusting nuts, and a set of locking bolts.

The cutterhead body 20 as shown in FIG. 4 is a solid metal cylinder having a diameter D sufficiently large to operate in the gap 18 between the in-feed table 12 and the out-feed table 17 at a level to position the periphery P of the body substantially flush with the workpiece receiving surface of the out-feed table 17.

The diameter D is about 0.25 inches larger than conventional to decrease the gaps between the periphery P and the table 17 to about 0.250 to 0.125 inches.

As shown, the body 20 has three knife slots 21 extending longitudinally along the length thereof in equally spaced circumferential relation.

Each knife slot 21 receives a metal cutter knife 22, a metal gib strip 23, five fastening bolts 24 and two adjusting nut assemblies 25. Only one set of knife, gib, bolts and nuts is shown for clarity in FIG. 4. The cutting knife 22 of each set is a hardened steel strip with a bevelled top cutting edge 22*a* tapered at an angle of about 45° from the flat plane faces of the strip. A typical knife will have a thickness of about 0.125 inches, a height of about 0.69 inches and a length, depending upon the size of the jointer or planer in which it is to be used such as, for example, 6 inches.

The chipbreaker gib 23 for use with the knife 22 is a steel strip commensurate in length with the knife but of substantially increased thickness in the order of 0.31 inches and a maximum height of about 0.75 inches with a chipbreaker pocket or groove 26 cut in the top trailing corner thereof having a radius of about 0.093 inches thus leaving a leading flat top 27 of about 0.16 inches and a reduced height rear wall 28 of about 0.68 inches. Tapped holes 29 are cut transversely through the gib strip 23 in spaced relation along the length thereof and they receive bolts 24 is threaded engagement therewith.

Each knife level adjusting nut assembly 25 as best shown in FIG. 7, has a hollow elongated tubular nut 25*a* with a tapped smaller hole 25*b* in the leading end and a flat front face 25*c* extending to a shoulder 25*d* adjacent the leading end. A set screw 31 is threaded through the tapped hole 25*b* and has a socket head 31*a* engageable with a tool inserted through the nut 25*a* to rotate the set screw.

For a cutter knife 22 and a chipbreaker gib 23 of the dimensions indicated, the cutterhead body 20 may have a diameter of about 3 inches, a length not less than 6 inches and slots 21 about 0.75 inches wide. As shown in FIG. 7 such a cutterhead body 20 has its slots 21 each with a stepped bottom having a portion 32 about 0.616 inches from the center C of the body as illustrated by the arrow lines $L_1$ and inclined at an angle of about 3° as illustrated at $L_2$. A deeper bottom portion 32*a* of the bottom of each slot has a depth of about 0.42 inches from the center line of the body as illustrated by the arrow $L_3$. The leading edges 33 of each slot are spaced circumferentially 120° but are inclined at about 3° as shown by the arrowed lines $L_4$. The trailing edges 34 of the slots 21 may also be tapered toward the leading edges 33 at a similar angle and extend to a bevelled edge 35 cut in the periphery P of the body 20 at an angle of about 30° as illustrated by the arrowed lines $L_5$. A flat bevelled peripheral wall portion 36 is thus provided diverging to each edge 35.

A pair of holes 37 are formed in each slot 21 spaced about 1.5 inches inwardly from the ends of the body and having a diameter of about 0.5 inches with a depth of about 1.12 inches from the edge 35 of the slot. The holes 37 open into the slot 21 for a portion of about 0.59 inches of their length and loosely receive the adjusting nut assemblies 25.

As shown in FIG. 5, the large diameter periphery P of the cutterhead body 20 has a close clearance running relationship with the tables 12 and 17 and projects into the gap 18 substantially flush with the top surface of the fixed out-feed table 17. The knife 22 has its cutting edge 22*a* protruding from the periphery P of the cutterhead body 20 a very short distance in the order of 0.015 inches. The chipbreaker gib 23 is then positioned down from the top cutting edge 22*a* of the knife so that the trailing edge of its pocket 26 is only about 0.03 inches below this edge 22*a* thus leaving a very small exposed leading face of the knife. The leading top corner 27 of the pocket 26 is then just about flush with the cutting edge 22*a* and positioned to clear the work just before the cut.

As shown, the bolts such as 24 are threaded into the holes 29 of the gib 23 with their heads bottomed on the leading side 33 of the slot 21 thereby wedging the gib against the knife 22 and in turn clamping the knife against the trailing side 33 of the slot. Since the bottom 32 and side wall 33 of the slot are inclined the clamping action will be in the nature of a wedge clamp to lock the knife and gib as centrifugal force of the rotating cutterhead body tends to eject the assembly from the slot 21.

To adjust the level of the knife and gib assembly in the slot 21 before the bolts 24 are tightened, the nut assemblies 25 in the holes 37 of the slot have their flat faces 25*c* bottomed on the face of the knife 22 with the shoulders 25*d* underlying the bottom of the knife. The set screws 31 are then bottomed on the bottoms of the holes 37 and are threaded through the tapped holes 25*b* to raise the hollow nuts 25*a* and the knife resting on their shoulders 25*d* to the desired level.

The height of the table 12 is adjusted relative to the path of the cutting edge 22*a* through the tap 18 to present the wood workpiece to the cutting edge for a maximum depth of cut consistent with a feed rate that will minimize the possibility of a kick back should the workpiece tilt into the gap.

As shown in FIG. 5, the operation of the cutter assembly 11 of this invention is contrasted with the prior art shown in dotted lines where the diameter of the prior art cutterhead 20' is substantially less than the cutterhead body 20 so that the periphery P' of the smaller diameter body 20' is spaced substantially below the level of the table 17 and to be effective the knife 22 must project beyond this periphery P' a much greater distance than beyond the periphery P with the chipbreaker gib 23' of the prior art being lower than the gib 23 of this invention and having its pocket 26' exposing a substantial length of the knife 22. This permits the workpiece W to tilt downwardly into the gap 18 wherein it will strike the wide exposed face of the knife 22 creating a kick back force illustrated by the arrow 38 throwing the workpiece back toward the operator with possible injury.

By contrast, the cutterhead assembly of this invention cannot permit the tilting of the workpiece since the periphery P of the increased diameter body 20 is substantially level with the face of the workpiece receiving table 17 and only a very minute portion of the blade is exposed which will substantially reduced the contact area and minimize the possibility of a kick back. Further, since the pocket 26 of the chipbreaker gib is at a higher level, chips from the cutting edge will be forced to curl into tight ribbons. Also because the exposed projection of the knife blade is minimal any air propelling or fan blade effect is minimal thus reducing noise in the operation of the cutterhead. Further, the gap between the cutterhead body and the in-feed and out-feed tables is minimized providing a desired close running clearance to avoid injury.

FIG. 6 illustrates the manner in which the cutterhead of this invention minimizes grain pull out of the workpiece. As shown, the cutting edge 22*a* of the knife 22 only projects a very slight distance above the periphery P of the cutterhead body 20 and only a slight distance above the pocket 26 of the chipbreaker gib 23 whereas in the prior art shown in dotted lines the knife blade projects a considerable distance above the periphery P' of the cutterhead body and when the in-feed table 12 of the jointer 10 is at a maximum cut level the workpiece W will thrust against the exposed knife edge attempting a thick cut W.C. of the wood but actually pulling the grain out of the wood and tearing out a chunk which can cause damage. Here again, the high level of exposure of the knife to the workpiece will create a kick back shown by the arrow 39.

To calculate knife projection the following data is obtained:

C=Knife Circle Radius (IN)
F=Feed Rate (IN/MIN)
K=No. of Knives
N=RPM
T=Depth of Cut (IN)
W=Advance of the board per knife (IN)
A=The half arc length from the cutter centerline to the point where the cutter exits the board.
R=Radius of Maximum Body Diameter Based on this data the following equations are applied:

$$W = \frac{F}{KN}$$

$$A = \sqrt{C^2 - (C - T)^2}$$

$$R = \sqrt{(A - W)^2 + (C - T)^2}$$

$$R = \sqrt{\left(\frac{A - F}{KN}\right)^2 + (C - T^2)}$$

Then, using these equations the projection for a 3 knife Jointer with the cutterhead rotating at 5000 RPM with a 1.5" knife circle radius, and a $\frac{1}{8}$" depth of cut at 600 IN/MIN feed rate is:

$$A = \sqrt{(1.5)^2 - (1.5 - .125)^2} = .5994789$$

$$R = \sqrt{\left(\frac{.5994789 - 600}{3(5000)}\right)^2 + 1.890625}$$

$$= 1.488$$

$$1.5 - 1.488 = .012''$$

This shows that 0.015 projection is a sufficient projection.

A feed rate of 600 IN/MIN can only be maintained with a power feeder, is very high and normally not used except in roughing.

From the above descriptions it should therefore be understood that this invention provides an improved cutterhead assembly for planers and jointers which minimizes kick back in operation, provides efficient chip curling and greatly increases the safety of operation of wood cutting machines.

We claim:

1. The method of planing wood which comprises sliding a workpiece on an in-feed planar surface across a gap to an out-feed planar surface, adjusting the level of the in-feed planar surface relative to the level of the out-feed planar surface to control the feed rate depth of cut of the wood, rotating a multiple cutter blade and chipbreaker pocket gib equipped cylindrical cutterhead behind said surfaces at said gap, maintaining the periphery of the cutterhead body exposed in the gap substantially level with the out-feed planar surface, projecting the cutter blades from the periphery of the cylindrical cutterhead into the gap just sufficiently beyond the adjusted level of the in-feed planar surface to effect the controlled depth of cut, and limiting the exposed leading face of each cutter blade at the chipbreaker pocket of the gib to not more than about twice the projection of the blade above the periphery of the cutterhead to thereby reduce blade exposure and grain pull out of said wood workpiece.

2. The method of planing wood on a planer or jointer of the type having a cylindrical cutterhead with the blades projecting into a gap between an adjustable level support surface for slidably supporting a wood workpiece and a fixed level receiving surface for the planed face of the workpiece and a chipbreaker gib positioned in front of each blade to curl chips cut from the workpiece by the blade which comprises providing a cylindrical cutterhead with a diameter sufficiently large to project the cylindrical periphery thereof into said gap flush with the fixed level receiving surface, projecting each blade from the cutterhead periphery about 0.015 inches, positioning each chipbreaker gib on the front face of each blade to expose only about 0.03 inches of the blade tip therebeyond and providing a chip receiving pocket in the outer end of each chipbreaker gib having a depth of about 0.08, a radius of about 0.09 inches and an open rear face substantially flush with the bottom of the pocket.

3. The method of planing wood on a planer or jointer of the type having a cylindrical cutterhead with a plurality of knife blades projecting into a gap between an adjustable level support surface for slidably supporting a wood workpiece a fixed level receiving surface for the planed face of the workpiece and a chipbreaker gib positioned in front of each blade to curl chips cut from the workpiece by the blade which comprises determining the following data from the planer or jointer:

C=Knife Circle Radius (IN)
F=Feed Rate (IN/MIN)
K=No. of Knives
N=RPM
T=Depth of Cut (IN)
W=Advance of the board per knife (IN)
A=The half arc length from the cutter centerline to the point where the cutter exits the board
R=Radius of Maximum Body Diameter applying the following equations to said data:

$$W = \frac{F}{KN}$$

$$A = \sqrt{C^2 - (C - T)^2}$$

-continued $$R = \sqrt{(A - W)^2 + (C - T)^2}$$

$$R = \sqrt{\left(\frac{A - F}{KN}\right)^2 + (C - T)^2},$$

and projecting the knives from the periphery of the cylindrical cutterhead a distance which is not substantially greater than the difference between the knife circle radius C and the radius of maximum body diameter R obtained from the aforesaid formulae.

4. The method of claim 1 including the step of providing a cylindrical cutterhead body of increased diameter to decrease the gap between the out-feed planar surface and the body to about 0.125 inches.

5. The method of claim 1 including the step of setting the blades to position their leading cutting edges about 0.015 inches beyond the periphery of the cylindrical cutterhead.

6. The method of claim 1 including the step of positioning the gib relative to its blade to expose only about 0.03 inches of blade to the chipbreaker pocket.

7. In a wood planing machine having an in-feed table and an out-feed table with a gap between the tables and means to adjust the level of the in-feed table to control the depth of cut of the wood, the improvement of a cutter head assembly having a cylindrical body of a diameter sufficiently large to project the periphery of the body into the gap between the tables at a level substantially flush with the out-feed table, said body having a plurality of longitudinal slots in the periphery thereof, each slot having leading and trailing sidewalls, a knife in each slot abutting the trailing sidewall thereof, adjusting nuts bottomed in the slots engaging the bottoms of the knives to project the knives a controlled distance beyond the periphery of the body, a gib in each slot bottomed on each knife, locking bolts threaded in each gib bottomed on the leading edge of the slot to wedge lock the gib and knife in the slot, each gib having a chip breaker pocket in the outer end thereof immediately in front of the knife with a trailing edge down from the knife edge not more than about twice the projection distance of the knife from the periphery of the body and a leading edge substantially flush with the knife edge positioned in advance of the knife edge to clear the wood just before the planing cut.

8. The further improvement of claim 7 wherein the adjusting nuts project the knives only about 0.015 inches beyond the periphery of the body.

9. The further improvement of claim 7 wherein each chip breaker pocket has a trailing edge not more than about 0.03 inches below the knife edge.

10. The further improvement of claim 7 wherein the leading sidewall of each slot is tapered to progressively widen the slot inwardly from the periphery of the body for increasing the wedge lock effect of the locking bolts in resisting outward centrifugal force movement of the knife and gib in the slot.

11. A wood planing machine which comprises an in-feed table, an out-feed table spaced from said in-feed table providing a cutter head gap between the table, means for adjusting the level of the in-feed table to control the depth of cut of the wood being planed, a cylindrical cutter head body rotatably mounted in the gap between said in-feed and out-feed tables having a periphery projecting into said gap at a level substantially flush with said out-feed table, said body having a plurality of circumferentially spaced longitudinal grooves in the periphery thereof with leading and trailing sidewalls and bottom walls, a knife in each groove bottomed on a trailing wall thereof, a gib in each groove bottomed on the knife, means bottomed in each groove adjustably projecting the outer edge of each knife beyond the periphery of the body, each gib having a chip breaker pocket in the outer end thereof immediately in front of each knife having a trailing edge down from the outer edge of the knife and a leading edge higher than the trailing edge positioned to clear the wood being planed.

12. The planer of claim 11 wherein the exposed leading face of the knife in each slot is not more than about twice the projection of the knife above the periphery of the cutterhead.

13. The planer of claim 11 wherein each blade projects from the cutter head periphery about 0.015 inches and the chip breaker pocket exposes only about 0.03 inches of the blade tip.

* * * * *